US011377834B2

(12) United States Patent
Zhou et al.

(10) Patent No.: US 11,377,834 B2
(45) Date of Patent: Jul. 5, 2022

(54) FLUSH TOILET

(71) Applicant: Globe Union Industrial Corp., Taichung (TW)

(72) Inventors: Hongsheng Zhou, Shen Zen (CN); Yanjun Wang, Shen Zen (CN); Shaoqing Li, Shen Zen (CN); Zhiqiang Liu, Shen Zen (CN); Wenjuan Li, Shen Zen (CN)

(73) Assignee: Globe Union Industrial Corp., Taichung (TW)

( * ) Notice: Subject to any disclaimer, the term of this patent is extended or adjusted under 35 U.S.C. 154(b) by 352 days.

(21) Appl. No.: 16/779,882

(22) Filed: Feb. 3, 2020

(65) Prior Publication Data

US 2021/0140163 A1 May 13, 2021

(30) Foreign Application Priority Data

Nov. 12, 2019 (CN) ..... 201911102717.6

(51) Int. Cl.
*E03D 11/08* (2006.01)

(52) U.S. Cl.
CPC ..... *E03D 11/08* (2013.01)

(58) Field of Classification Search
CPC ..... E03D 11/08; E03D 11/02
USPC ..... 4/421
See application file for complete search history.

(56) References Cited

U.S. PATENT DOCUMENTS

| | | | | |
|---|---|---|---|---|
| 7,661,153 | B2 | 2/2010 | Nakamura et al. | |
| 9,359,753 | B2 * | 6/2016 | Hirakawa | E03D 11/08 |
| 2018/0195261 | A1 * | 7/2018 | Hashimoto | E03D 11/08 |

* cited by examiner

*Primary Examiner* — Lauren A Crane
(74) *Attorney, Agent, or Firm* — Karin L. Williams; Alan D. Kamrath; Mayer & Williams PC

(57) ABSTRACT

A flush toilet is revealed. The flush toilet includes a bowl portion, a drain pipe, an inlet channel, a first outlet channel, a second outlet channel, and a jet channel. The first and second outlet channels are turned into different directions from diversion area of the inlet channel. The second outlet channel further includes a curved potion for changing the direction of water flow so that the direction of a second water flow out of the second outlet channel and along a shed portion of the bowl portion is consistent with the direction of a first water flow out of the first outlet channel and along the shed portion. Thus the first and second water flows are out almost synchronously throughout the bowl portion and combined to form a swirling flow which interacts with a third water flow from the jet channel to create a siphon effect for better waste removal.

14 Claims, 9 Drawing Sheets

FLUSH TOILET

BACKGROUND OF THE INVENTION

Field of the Invention

The present invention relates to a toilet, especially to a flush toilet which generates a strong swirling flow for flushing and waste removal.

Description of Related Art

The flush toilet available now has certain shortcomings such as poor flushing performance or inefficient waste removal, especially those with water-saving function. In order to meet requirements for water-saving, a swirling flow which is generated by a less amount of water and achieving better flushing and waste removal performance is applied broadly. For example, a is plurality of spray outlets is disposed above the bowl portion to generate swirling effect. By the spray outlets used in combination with spray outlets arranged in front of or at the back of a lower part of the bowl portion, waste removal performance is improved.

Refer to Chinese Pat. No. ZL03819005.2, a flush toilet is revealed. The structure of the flush toilet includes a skirt portion at a lower part of the flush toilet and a bowl portion in front of a lower part of the flush toilet. A water guiding passage and a drain passage are respectively formed on an upper part and a lower part of the back side of the flush toilet. Using a longitudinal axis of the bowl portion as the central axis, a first water, a first spray outlet and a second spray outlet are respectively arranged at each of two sides of the bowl portion. After flowing through the water guiding passage, a certain amount of flush water from a tank is flowing to the first spray outlet and the second spray outlet through an upper and a lower connection holes with protruding rims respectively, along shed portions adjacent to the protruding rims and finally rotating and entering a flushing surface of the bowl portion. Thereby a swirl flow in specific direction is generated for flushing the flushing surface, especially the dry area. Moreover, a part of flush water through the lower connection hole with the protruding rim is flowing to a press water spray outlet is under the water for pushing waste toward the drain passage and discharging the flush water at the same time.

In this prior art, there are three flushing water flows. Two of them are flowing from different positions at the shed portion, not only along the shed portion but also flowing into the bowl portion to generate the swirling flow for flushing the flushing surface while the third flushing water flow is under the water for pressing the waste into the drain passage.

There is no denying that the above design achieves some desired effects yet there are still certain shortcomings. For example, the second water flow from the second spray outlet is used to make up for the deficiency in strength of the first flushing water flow. The path of the second flushing water flow being guided is about the same as the path of the first flushing water flow before coming out from the first spray outlet, after coming out from the first spray outlet and during movement along the shed portion. Both the first and the second flushing water flows are flowing toward the front side of the bowl portion and then turned to the back side of the bowl portion. It is easily understood that the second flushing water flow has a longer guided path so that not only the strength of the water flow is reduced, the flushing effect on the bowl surface is reduced. The time point the second flushing water flow coming out of the second spray is significantly delayed. Thus the strength of the swirling flow generated by combination of the second flushing water flow and the first flushing water flow is dramatically reduced. Under ideal conditions, the first flushing water flow coming out from the first spray outlet should be synchronous with the second flushing water flow coming out from the second spray outlet, or the time points are very close to each other. Thereby the two water flows rotating in the same direction are combined and working together to have synergistic effect and generate the strongest swirling flow. However, the second flushing water flow is still limited and flowing within its own water passage when the first flushing water flow is moving along the shed portion and flushing into the bowl portion at the same time after coming out from the first spray outlet. The second flushing water flow doesn't come out of the second spray outlet until the path of the first flushing water flow along the shed portion is almost completed. There is a huge difference in "coming-out" time of the two flushing water flows and this leads to a poor swirling effect.

Moreover, the third flushing water flow is firstly diverted through the lower connection hole with the protruding rim and flows through an opening on the bottom and then moves along the water passage and comes out from the press water spray outlet under the water in the bowl portion. The path of the third flushing water flow is quite short and a bit inclined. Although the third flushing water flow can press the waste under the water quite well and even generate a siphon effect earlier. However, the time difference between the time of the third flushing water flow coming out and the time of the beginning of the siphon effect is too long. Although the siphon effect occurs, the strength of the following water supply is insufficient and this affects the siphon effect and further has negative effects on waste removal. Under ideal conditions, after the third flushing water flow initiates the siphon effect and the first and the second flushing water flows are combined to generate a swirling flow for concentrating water supply in the shortest time. Thereby the siphon effect is maintained at the optimal state to provide best water removal.

Thus there is room for improvement and there is a need to provide a novel flush toilet.

SUMMARY OF THE INVENTION

Therefore it is a primary object of the present invention to provide a flush toilet which improves overall strength of swirling flow effectively for better is flushing and waste removal performance.

In order to achieve the above object, a flush toilet according to the present invention includes a bowl portion, a drain pipe, an inlet channel, a first outlet channel, a second outlet channel, and a jet channel.

The bowl portion consists of a bowl-like waste receiving surface, an inner flange portion projecting from an inner surface on an upper part of the bowl portion, and a shed portion located between the waste receiving surface and the inner flange portion.

An inlet is formed on one end of the drain pipe and connected to the bottom of the bowl portion for waste removal.

The inlet channel includes a water inlet formed on one end for allowing water to flow into the inlet channel and a diversion area formed on the other end.

One end of the first outlet channel is connected to and communicating with the diversion area of the inlet channel for guiding water to pass through a first outlet on the other end of the first outlet channel and flow toward the shed portion of the bowl portion so as to form a first water flow.

One end of the second outlet channel is connected to and communicating with the diversion area of the inlet channel for guiding water to pass through a second outlet on the other end of the second outlet channel and flow toward the shed portion of the bowl portion so as to form a second water flow.

One end of the jet channel is connected to and communicating with the diversion area of the inlet channel for guiding water to pass through a jet hole on the other end of the jet channel and flow down to the water in the bowl portion so as to form a third water flow.

The first outlet channel and the second outlet channel are respectively formed on each of the two sides of the bowl portion divided by a central axis X in the longitudinal direction of the bowl portion. The first outlet is located at a middle portion between the position P1 and the position P2 of the bowl portion.

The position P1 is located at a junction point where the bowl portion is changed from a smaller radius of curvature to a larger radius of curvature while the position P2 is at the back of the bowl portion. The second outlet is located at a middle portion between the position P3 and the position P2 of the bowl portion. is The position P3 is the junction point where the bowl portion is changed from a larger radius of curvature to a smaller radius of curvature. The second outlet channel further includes a curved potion for guiding and changing the direction of the water flow. Thus the direction of the second water flow which moves along the shed portion after flowing from the second outlet to the shed portion is consistent with the direction of the first water flow which moves along the shed portion after flowing from the first outlet to the shed portion so as to generate a swirling flow.

Preferably, an arc length traveled along the shed portion from the first outlet to the position P1 is S1 while another arc length traveled along the shed portion from the position P2 to the first outlet is S2. The ratio of S1 to S2 (S1/S2) ranges from 0.4 to 0.6.

Preferably, an arc length traveled along the shed portion from the second outlet to the position P2 is S3 while another arc length traveled along the shed portion from the position P3 to the second outlet is S4. The ratio of S3 to S4 (S3/S4) is ranging from 0.2 to 0.4.

Preferably, the cross-sectional area of the first outlet is larger than that of is the second outlet.

Preferably, the ratio of the water flowing out of the first outlet, the second outlet and the jet hole is 0.6:0.4:3.8 when the amount of water the inlet channel can supply is 4.8 liter (L).

Preferably, a lower part of the shed portion is inclined downward from the horizontal toward the bottom of the bowl portion and the height difference of the lower part is ranging from 0 mm to 2.5 mm.

Preferably, the width of the shed portion is gradually decreased from the first outlet to the position P1 along the direction of the water flow. The width of the shed portion is fixed from the position P1 to the position P3 along the direction of the water flow. The width of the shed potion is gradually decreased from the position P3 to the second outlet 51 along the direction of the water flow. The width of the shed portion becomes smaller from the second outlet to the first outlet along the direction of the water flow. The width of the shed portion at the position of the first outlet is about the same as that at the position of the second outlet.

Preferably, the width of the inlet channel is getting narrower from the water inlet to the diversion area along the direction of the water flow.

Preferably, the width of the first outlet channel is getting smaller along the direction of the water flow.

Preferably, the width of the second outlet channel is gradually decreased along the direction of the water flow.

Preferably, the width of the jet channel is gradually reduced along the direction of the water flow.

Preferably, the time difference between the time of the first water flow flowing out of the first outlet and the time of the second water flow flowing out of the second outlet is within 1.5 seconds.

Preferably, a part of a side wall of the first outlet channel, a part of a side wall of the second outlet channel and a side wall of the shed portion next to the first and the second outlet channels are formed by a partition assembly which is located and adhered between a bottom wall surface of the first outlet channel/the second outlet channel and a bottom wall surface of a seat.

Preferably, the partition assembly is composed of a first partition plate and a second partition plate. The first partition plate is a curved strip which forms a part of the side wall of the first outlet channel, a part of the side wall of the second outlet channel, and the first outlet. The second partition plate which can be L-shaped, U-shaped or C-shaped forms a part of the side wall of the second outlet channel close to the second outlet. The second partition plate is also in combination with the first partition plate to form a part of the second outlet.

The present invention has the following advantages. By the design of the first outlet channel and the second outlet channel being turned into different directions from the diversion area of the inlet channel in combination with the curved potion of the second outlet channel, the direction of the second water flow after flowing from the second outlet to the shed portion is consistent with the direction of the first water flow. Such design also ensures that the first water flow and the second water flow come out almost synchronously. Thus the first water flow and the second water flow are not only moved along the shed portion but also evenly flowing throughout the bowl portion and combined to form a strong swirling flow. Thereby the flushing performance on the waste receiving is surface is significantly improved. Moreover, the swirling flow can rapidly interact with a third water flow from the jet hole to create an extremely powerful siphon effect for discharging the waste into the drain pipe quickly and efficiently. Therefore the flush toilet offers better waste removal performance.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
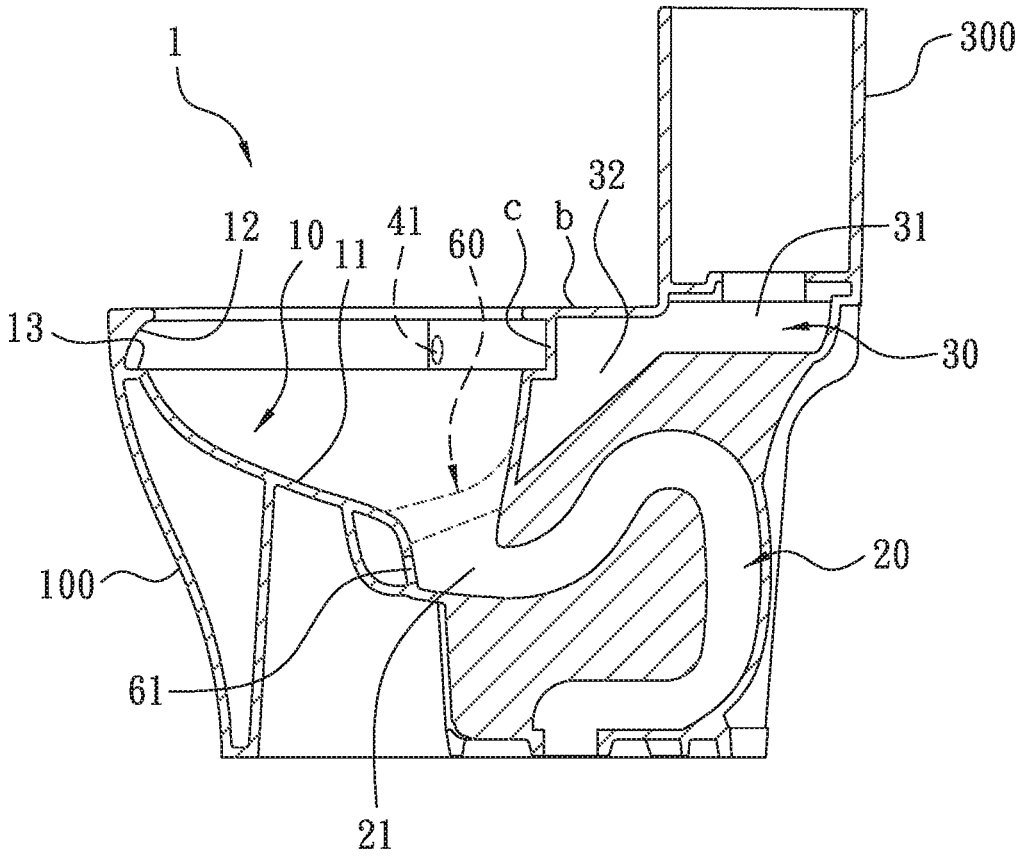
FIG. 1 is a longitudinal sectional view of an embodiment of a flash toilet according to the present invention.

The features of the present invention will be shown by the following embodiments and the accompanying drawings. The same reference numeral or similar reference numerals is/are used to represent the same component or the components with similar functions. However, the embodiments and the accompanying drawings are given only for purpose of illustration and explanation, and not to be taken as limiting the scope of the present invention.

It should be understood that terms such as "length", "width", "upper", "lower", "front", "back", "longitudinal", "horizontal", "top", "bottom" and "inner" should be constructed to refer to the orientation as then described or as shown in the drawings. These relative terms are for convenience of description and do not require that the present invention to constructed or operated in a particular orientation.

In addition, terms such as "first", "second" and "third" are used herein for purposes of description and the components and are not intended to indicate or imply the number of indicated technical features. Thus, the feature defined with "first" and "second" may expressly or impliedly include at least one or more of this feature. In the description of the present disclosure, "a plurality of" means at least two unless specified otherwise.

In the present disclosure, unless specified or limited otherwise, the terms "mounted, "coupled", "connected", "fixed" and the like are used broadly and may be, for example, fixed connections, detachable connection, or integral connection; may also be mechanical or electrical connections; may also be direct connections or indirect connections via intervening structures; may also be inner communications or interaction of two elements, which can be understood by those skilled in the art according to specific situations.

Figure 2:
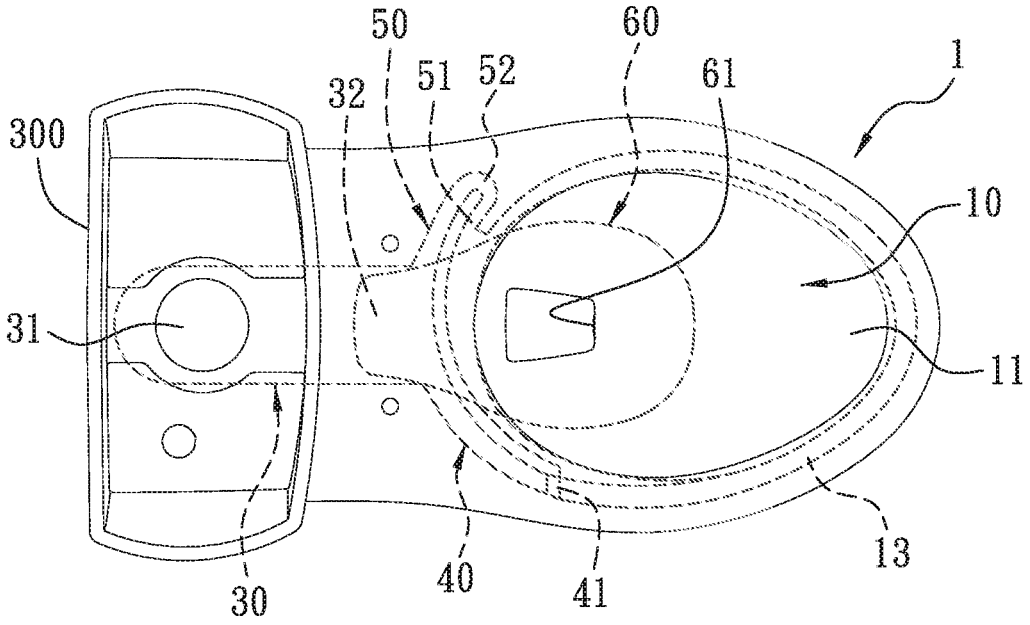
FIG. 2 is a top view of an embodiment of a flash toilet according to the present invention.
Figure 3:
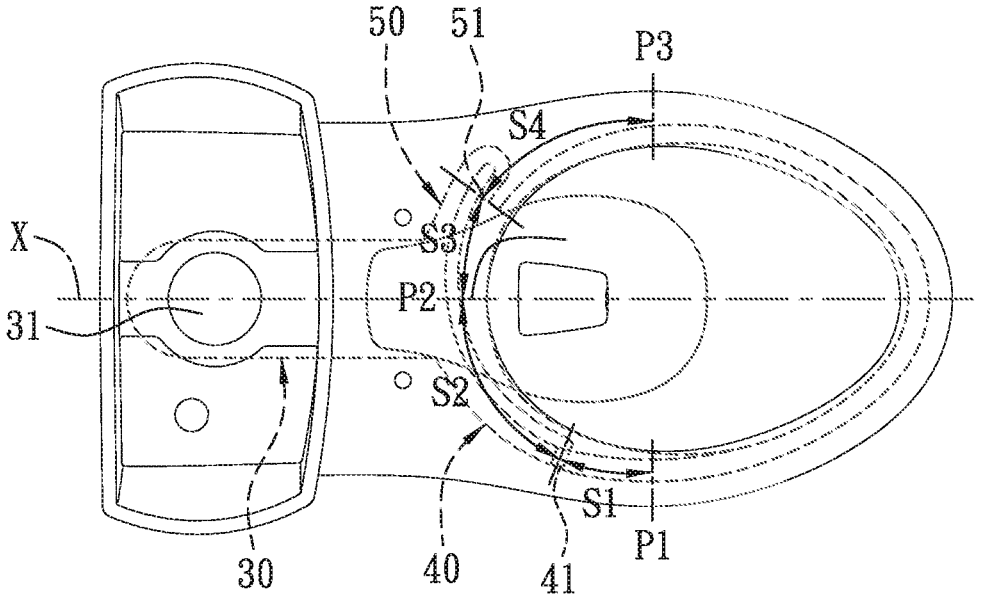
FIG. 3 is a top view of an embodiment of a flash toilet showing a central axis, junction positions, and a back position according to the present invention.

Refer to FIG. 1, FIG. 2 and FIG. 3, a flush toilet 1 according to the present invention mainly includes a bowl portion 10, a drain pipe 20, an inlet channel 30, a first outlet channel 40, a second outlet channel 50, and a jet channel 60.

The bowl portion 10 consists of a bowl-shaped waste receiving surface 11, an inner flange portion 12 projecting from an inner surface on an upper part of the bowl portion 10, and a shed portion 13 located between the waste receiving surface 11 and the inner flange portion 12. The bowl portion 10 is disposed in front of an upper part of the flush toilet 1 and a skirt-like portion 100 is formed in front of a lower part of the flush toilet 1.

An inlet 21 is formed on one end of the drain pipe 20 and connected to the bottom of the bowl portion 10 for waste removal. In this embodiment, the drain pipe 20 is formed behind the lower part of the flush toilet 1.

The inlet channel 30 includes a water inlet 31 formed on one end and a diversion area 32 formed on the other end. Water flows into the inlet channel 30 through the water inlet 31 which is formed behind the upper part of the flush toilet 1. The top of the water inlet 31 is connected to and communicating with a cistern 300 which is used for storage of a certain amount of water and operable to control the water flowing into the inlet channel 30 through the water inlet 31.

One end of the first outlet channel 40 is connected to and communicating with the diversion area 32 of the inlet channel 30 for guiding water to pass through a first outlet 41 on the other end of the first outlet channel 40 and flow toward the shed portion 13 of the bowl portion 10 so as to form a first water flow.

One end of the second outlet channel 50 is connected to and communicating with the diversion area 32 of the inlet channel 30 for guiding water to pass through a second outlet 51 on the other end of the second outlet channel 50 and flow toward the shed portion 13 of the bowl portion 10 so as to form a second water flow.

One end of the jet channel 60 is connected to and communicating with the diversion area 32 of the inlet channel 30 for guiding water to pass through a jet hole 61 on the other end of the jet channel 60 and flow down to the water in the bowl portion 10 so as to form a third water flow below the water surface. In this embodiment, the jet hole 61 is located in front of the bowl portion 10 and aligned with the inlet 21 of the drain pipe 20.

Figure 4:
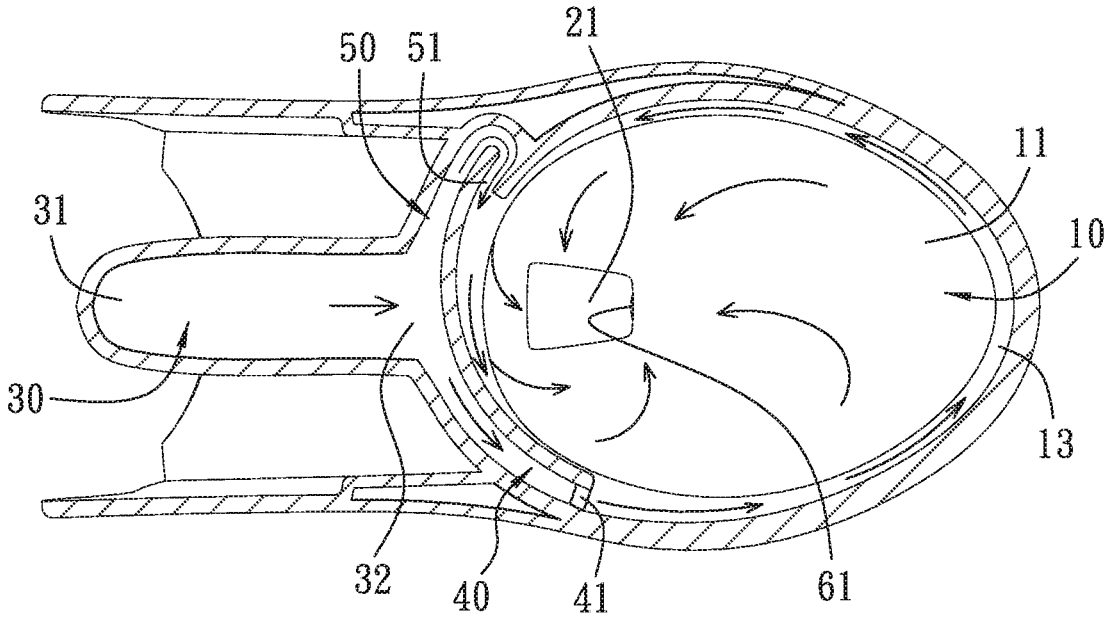
FIG. 4 is a horizontal sectional view of an embodiment of a flush toilet showing a first water flow and a second water flow flowing along a shed portion and throughout a bowl portion to form a swirling flow according to the present invention.

As shown in FIG. 3, the first outlet channel 40 and the second outlet channel 50 are respectively on the two sides of the bowl portion 10 divided by a central axis X along the longitudinal direction of the bowl portion 10. The first outlet 41 is located at a middle portion between the position P1 and the position P2 of the bowl portion 10. The position P1 is located at a junction point where the bowl portion 10 is changed from a smaller radius of curvature to a larger radius of curvature while the position P2 is at the back of the bowl portion 10. The position P1 is defined as the junction position and the position P2 is defined as the back position. The second outlet 51 is located at a middle portion between the position P3 and the position P2 of the bowl portion 10. The position P3 is the junction point where the bowl portion 10 is changed from a larger radius of curvature to a smaller radius of curvature, also called the junction position. The second outlet channel 50 further includes a curved potion 52 for guiding and changing the direction of the water flow, as shown in FIG. 2. Thus the direction of the second water flow which is flowing from the second outlet 51 to the shed portion 13 and moving along the shed portion 13 is consistent with the direction of the first water flow that is flowing from the first outlet 41 to the shed portion 13 and moving along the shed portion 13. Thereby a swirling flow is generated. As shown in FIG. 4, it is clear that the first water flow moves in a counterclockwise direction and the second water flow also turns in a counterclockwise direction. Thereby rotation direction of the first water flow is consistent with that of the second water flow. The water flow rotates counterclockwise and the second water flow rotates in the same direction so that the direction of rotation of the first water flow is consistent with that of the second water flow.

As shown in FIG. 3, in this embodiment, an arc length traveled along the shed portion 13 from the first outlet 41 to the position P1 is S1 while another arc length traveled along the shed portion 13 from the position P2 to the first outlet 41 is S2. The ratio of S1 to S2 (S1/S2) is ranging from 0.4 to 0.6.

As shown in FIG. 3, in this embodiment, an arc length traveled along the shed portion 13 from the second outlet 51 to the position P2 is S3 while another arc length traveled along the shed portion 13 from the position P3 to the second outlet 51 is S4. The ratio of S3 to S4 (S3/S4) is ranging from 0.2 to 0.4. The arc length between the second outlet 51 and the position P2 looks shorter than the arc length between the first outlet 41 and the position P2. Yet the curved potion 52 is designed to be at the middle of the second outlet channel 50. Thus the actual length of the water flow path of the second outlet channel 50 is only a bit shorter than or even equal to the length of the water flow path of the first outlet channel 40. Such design ensures that the time difference between the time of the is first water flow flowing out of the first outlet 41 and the time of the second water flow flowing out of the second outlet 51 is controlled to be within 1.5 seconds.

Figure 5:
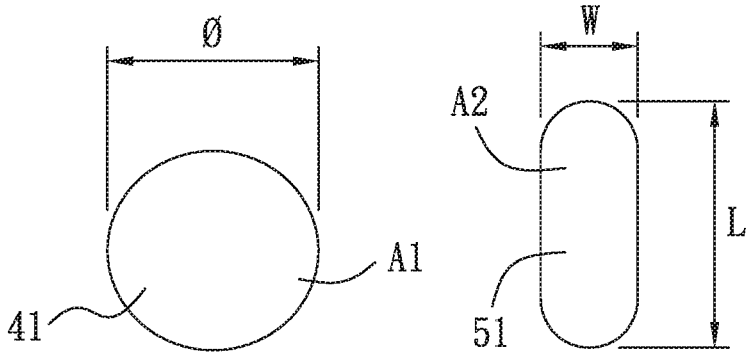
FIG. 5 shows shapes and sizes of a first outlet and a second outlet of an embodiment according to the present invention.

Refer to FIG. 5, in this embodiment, the cross-sectional area of the first outlet 41 is larger than that of the second outlet 51. The first outlet 41 is a circular orifice with a diameter (Ø) of 22 mm while the second outlet 51 is an oblong hole with the length (L) of 28 mm and the width (W) of 10 mm. Thereby it is assured that the flow sectional area A1 of the first outlet 41 is larger than the flow sectional area A2 of the second outlet 51. That means the amount of water flowing out of the first outlet 41 is more than the amount of water flowing out of the second outlet 51 under normal conditions.

It should be noted that the shape of the first outlet 41 is preferably a circle. The shape of the first outlet 41 can also be oblong or rectangular. Similarly, the shape of the second outlet 51 is preferably oblong. The shape of the second outlet 51 can also be round or rectangular.

In this embodiment, when the amount of water the inlet channel 30 can supply is 4.8 liter (L), the ratio of the water flowing out of the first outlet 41, the is second outlet 51 and the jet hole 61 is 0.6:0.4:3.8. That means when the certain amount of water stored in the cistern 300 is 4.8 L, the amount of the water flowing out of the first outlet 41 is about 0.6 L while the amount of the water flowing out of the second outlet 51 is about 0.4 L and the amount of the water flowing out of the jet hole 61 is about 3.8 L. Based on the above design of the amount of the water output, it is ensured that the largest amount of water is flowing out of the jet hole 61 so as to increase the amount of water used for flushing waste and later entering into the sewage inlet. Thus sufficient siphon effect is generated to discharge waste through the drain pipe 20 smoothly. The second most amount of water is flowing form the first outlet 41, along the longer side of the shed portion 13 and then into the bowl portion 10 for flushing most of the waste receiving surface 11. The least amount of water is flowing out of the second outlet 51, along the shorter side of the shed portion 13 and then into the bowl portion 10 for flushing the rest of the waste receiving surface 11.

Figure 6:
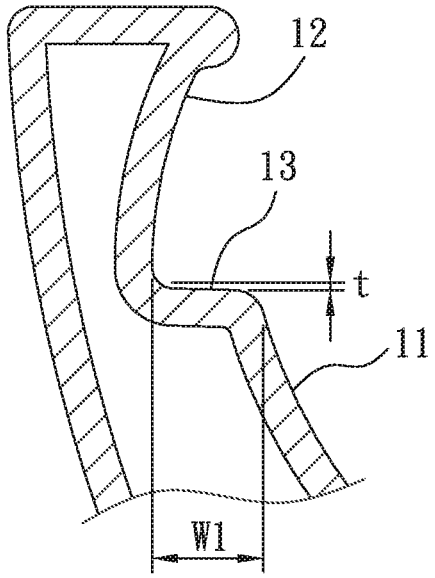
FIG. 6 is an enlarged partial longitudinal sectional view of a shed portion of an embodiment according to the present invention.

Refer to FIG. 6, in this embodiment, a lower part of the shed portion 13 is inclined downward from the horizontal toward the bottom of the bowl portion 10 and the height difference t of the lower part of the shed portion 13 is ranging from 0 mm to 2.5 mm. The inclined design ensures that the first water flow from the first outlet 41 and the second water flow from the second outlet 51 are not is only flowing along the shed portion 13 but also flowing downward evenly to be distributed over the bowl portion 10 for flushing at the same time.

Figure 7:
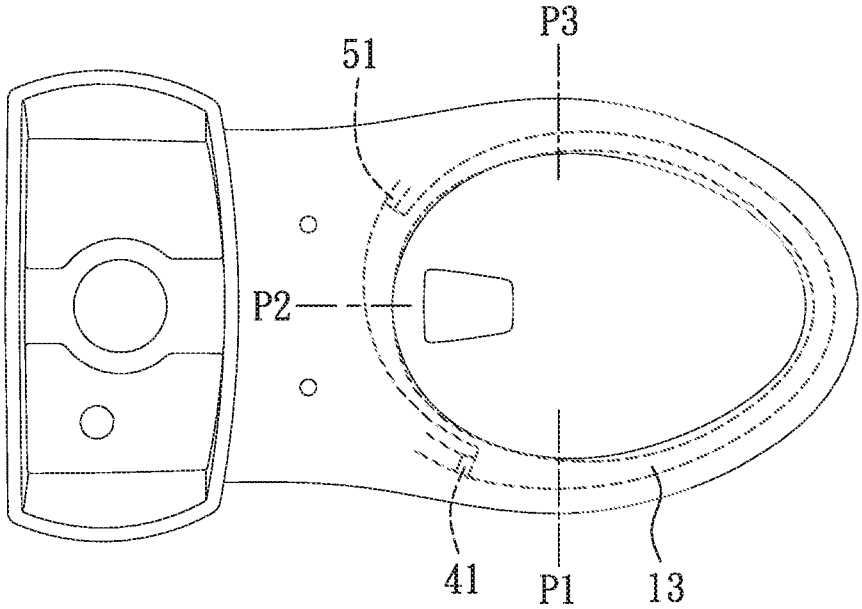
FIG. 7 is a top view of an embodiment of a flash toilet showing junction positions, a back position and changes in width at different positions of a shed portion according to the present invention.

As shown in FIG. 6 and FIG. 7, in this embodiment, the width of the shed portion 13 represented by W1 is gradually decreased from the first outlet 41 to the position P1 along the direction of the water flow. The width W1 is fixed from the position P1 to the position P3 along the direction of the water flow. The width of the shed potion 13, W1, is gradually decreased from the position P3 to the second outlet 51 along the direction of the water flow. The width W1 becomes smaller from the second outlet 51 to the first outlet 41 along the direction of the water flow. The width W1 at the position of the first outlet 41 is about the same as the width W1 at the position of the second outlet 51. The narrower design of the shed portion 13 is for even distribution of the water flow throughout the bowl portion 10 to achieve the best flushing performance.

Figure 8:
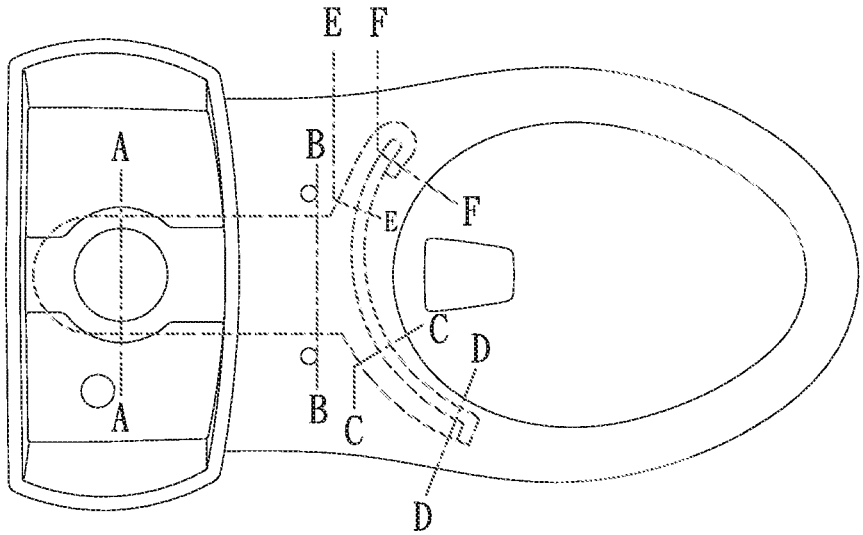
FIG. 8 is a top view of an embodiment showing positions of a plurality of sections according to the present invention.
Figure 9:
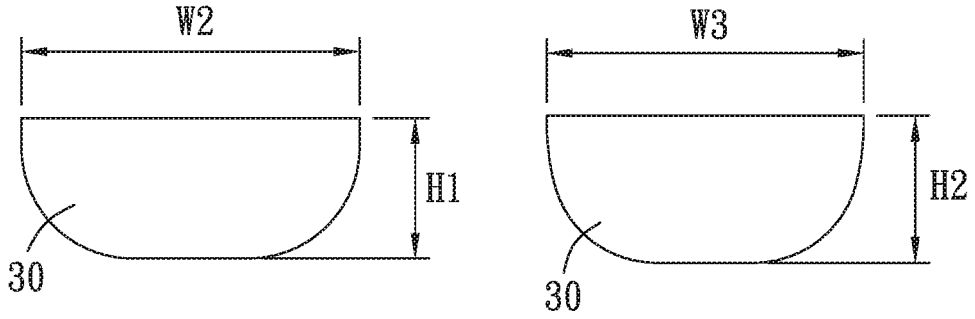
FIG. 9 shows shapes and sizes of two cross sections along the line A-A and the line B-B at different positions of an inlet channel of the embodiment shown in FIG. 8 according to the present invention.

Refer to FIG. 8 and FIG. 9, the width of the inlet channel 30 is getting narrower from the water inlet 31 to the diversion area 32 along the direction of the water flow. For example, the section of the inlet channel 30 looks like a bowl. The section of the inlet channel 30 along the line A-A at the position near the water inlet 31 is with the width W2 of 102 mm and the height H1 of 44 mm is while the section of the inlet channel 30 along the line B-B at the position near the diversion area 32 has the width W3 of 96 mm and the height H2 of 47 mm.

Figure 10:
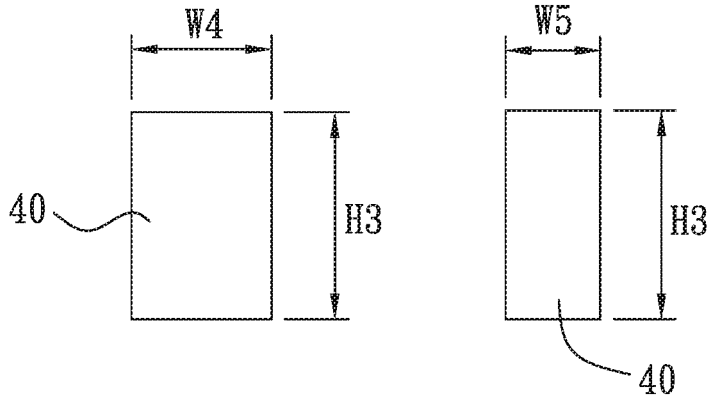
FIG. 10 shows shapes and sizes of two cross sections along the line C-C and the line D-D at different positions of a first outlet channel of the embodiment shown in FIG. 8 according to the present invention.
Figure 11:
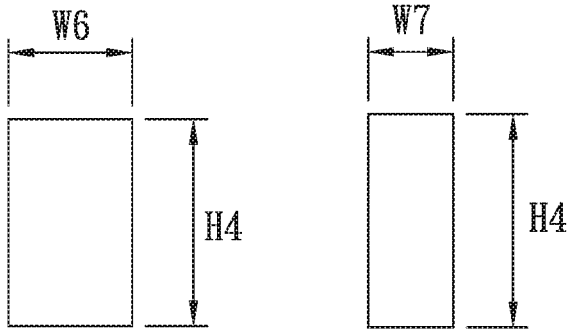
FIG. 11 shows shapes and sizes of two cross sections along the line E-E and the line F-F at different positions of a second outlet channel of the embodiment shown in FIG. 8 according to the present invention.
Figure 12:
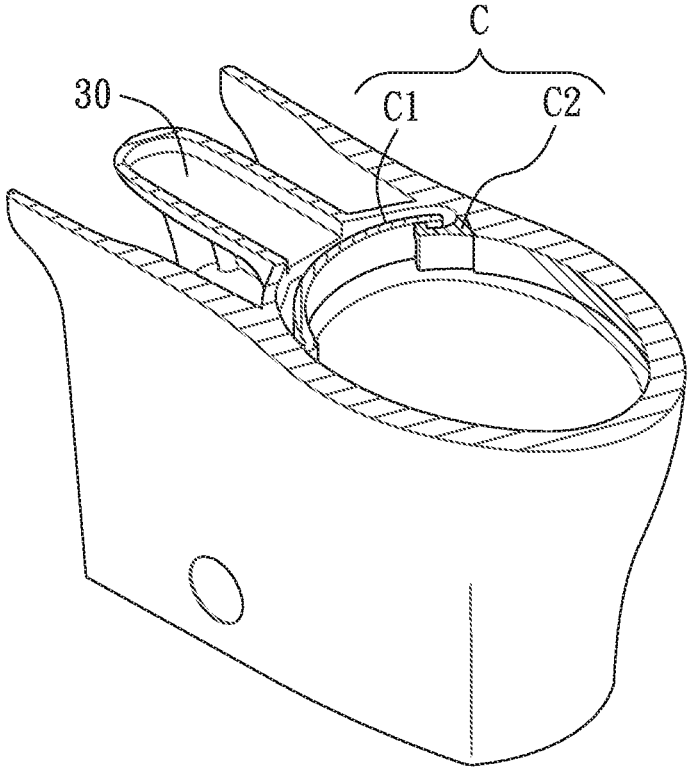
FIG. 12 is a horizontal sectional view of an embodiment with a partition is assembly of an embodiment according to the present invention.
Figure 13:
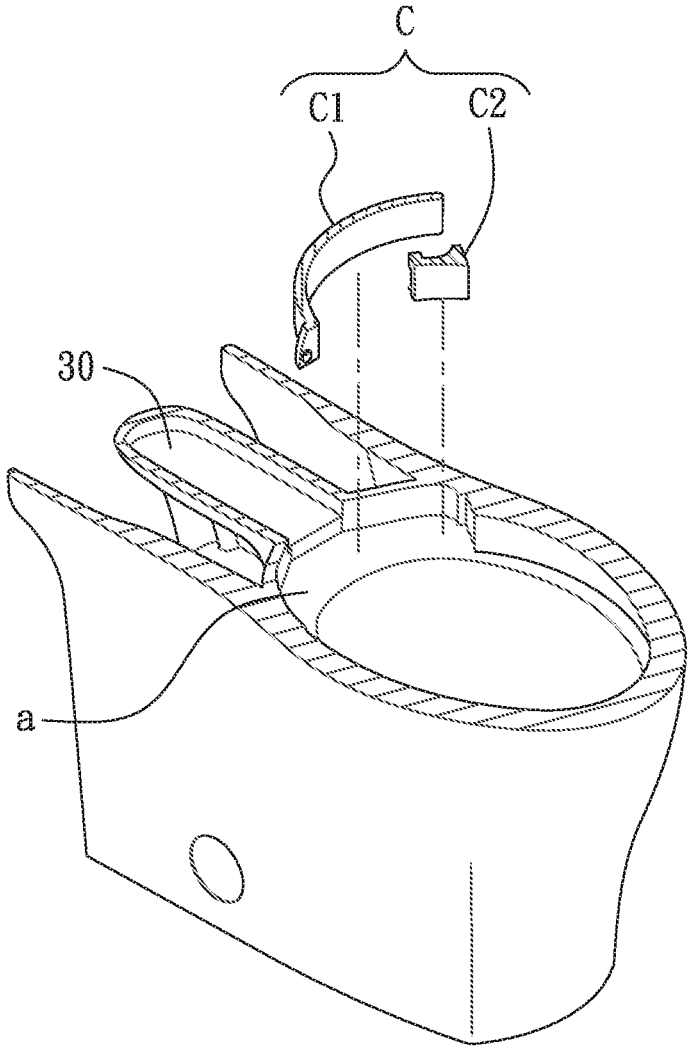
FIG. 13 is a schematic drawing showing a partition assembly separated from a flush toilet of an embodiment according to the present invention.
Figure 14:
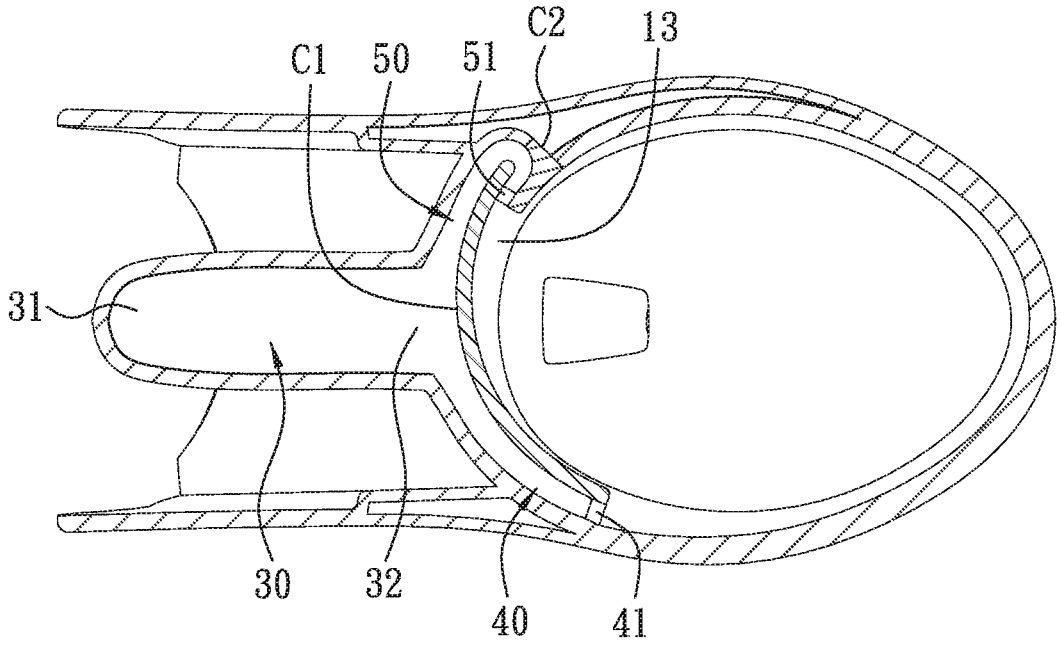
FIG. 14 is a horizontal sectional view of an embodiment showing relationship among a partition assembly, a first outlet channel, a second outlet channel and a shed portion

As shown in FIG. 10, in tis embodiment, the width of the first outlet channel 40 is getting smaller along the direction of the water flow and so is the second outlet channel 50. For example, the section of the first outlet channel 40 is about a rectangle. The section of the first outlet channel 40 along the line C-C at the position near the inlet is with the width W4 of 25 mm and the height H3 of 40 mm while the section of the first outlet channel 40 along the line D-D at the position near the first outlet 41 is with the width W5 of 17 mm and the height H3 of 40 mm. As shown in FIG. 11, the shape of the section of the second outlet channel 40 is also about rectangular. The section of the second outlet channel 50 along the line E-E at the position near the inlet is with the width W6 of 22 mm and the height H4 of 40 mm while the section of the second outlet channel 50 along the line F-F at the position near the second outlet 51 is with the width W7 of 15 mm and the height H4 of 40 mm.

Based on the above embodiments, it is easily learned that the narrower design of the inner width of the inlet channel 30, the inner width of the first outlet channel 40, and the inner width of the second outlet channel 50 is all for increasing the speed of the water flow. Thus the water flowing out of the first outlet 41 and the second outlet 51 produces a greater impact force on the waste receiving surface 11 while flowing along the shed portion 13 and downward to be distributed throughout the inner surface of the bowl portion 10 synchronously. Therefore the flushing performance is improved. Similarly, the inner width of the jet channel 60 can also be designed to be gradually smaller.

Refer to FIG. 1 and FIG. 12-14, a part of a side wall of the first outlet channel 40, a part of a side wall of the second outlet channel 50 and a side wall of the shed portion 13 next to the first and the second outlet channels 40, 50 are formed by a partition assembly c located and adhered between the bottom wall surface a of the first outlet channel 40/the second outlet channel 50 and the bottom wall surface of a seat b. The partition assembly c consists of a first partition plate cl and a second partition plate c2. The first partition plate cl is a curved strip which forms a part of the side wall of the first outlet channel 40, a part of the side wall of the second outlet channel 50, and the first outlet 41. The second partition plate c2 which can be L-shaped, U-shaped or C-shaped forms a part of the side wall of the second outlet channel 50 close to the second outlet 51. The second partition plate c2 together with the first partition plate c1 forms a part of the second outlet 51. Thus excellent flow diversion effect is achieved by means of the partition plates c1, c2 mentioned above. Moreover, the independent partitions c1, c2 are easy to be produced precisely. After being formed, the partitions c1, c2 are integrated into the flash toilet 1 by easy adhesion and fixation.

In summary, the flush toilet 1 according to the present invention has the following features and advantages:

1. In the present flush toilet 1, the first outlet channel 40 and the second outlet channel 50 are turned into different directions from the diversion area 32 of the inlet channel 30. The above design features on the curved potion 52 disposed in the second outlet channel 50 for directing the water flow to change directions.

Thereby the direction of the second water flow out of the second outlet 51 is consistent with the direction of the first water flow after flowing to the shed portion 13. Compared with the structure available now, such design reduces the length of the water flow path significantly so that the first water flow and the second water flow come out almost at the same time. Thus the first water flow and the second water flow are not only moved along the shed portion 13 but also evenly flowing throughout the bowl portion 10 and combined to form a strong swirling flow. The reduction of the strength of the swirling flow caused by a delay in mixing of the water flows will be minimized. Therefore the water is flushing performance on the waste receiving surface 11 is dramatically improved.

2. The above strong swirling flow formed by mixing of the water flows is generated much earlier. Thus the swirling flow can interact with the third water flow from the jet hole 61 to create an extremely powerful siphon effect for discharging waste into the drain pipe 20 through the inlet 21 in one go. Thereby the flush toilet 1 offers excellent flushing performance.
3. In combination with other fine structural designs of the flush toilet 1, both the impact force and the fluency/distribution of the water flow are improved by increasing the speed of the water flow. For example, the narrower design of the width of the inlet channel 30, the first outlet channel 40, and the second outlet channel 50 as well as the changes in the width at different positions of the shed portion 13 is for achieving the above purpose. Thereby the overall flushing effect is further enhanced.
4. By the design of the size such as shape and width of the first outlet channel 40, the second outlet channel 50 and the jet channel 60 in combination with the design of the cross section of the first outlet 41, the second outlet 51 and the jet hole 61 for water flow, the certain amount of water flowing into the inlet channel 30 is distributed optimally. Thus the first water flow, the second water flow and the third water flow can achieve the best flushing or waste removal performance with less amount of water, without affecting one another and further causing limits on flushing or waste removal performance at specific area or positions.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A flush toilet comprising: a bowl portion which includes a bowl-shaped waste receiving surface, an inner flange portion projecting from an inner surface on an upper part of the bowl portion, and a shed portion located between the waste receiving surface and the inner flange portion; a drain pipe having an inlet formed on one end thereof while the inlet is connected to the bottom of the bowl portion for waste removal; an inlet channel which includes a water inlet formed on one end thereof for allowing water to flow into the inlet channel and a diversion area formed on the other end thereof; a first outlet channel having one end thereof connected to and communicating with the diversion area of the inlet channel for guiding water to pass through a first outlet on the other end of the first outlet channel and flow toward the shed portion of the bowl portion so as to form a first water flow; a second outlet channel having one end thereof connected to and communicating with the diversion area of the inlet channel for guiding water to pass through a second outlet on the other end of the second outlet channel and flow toward the shed portion of the bowl portion so as to form a second water flow; and a jet channel having one end thereof connected to and communicating with the diversion area of the inlet channel for guiding water to pass through a jet hole on the other end of the jet channel and flow down to the water in the bowl portion so as to form a third water flow under the water; the jet hole is located in front of the bowl portion and aligned with the inlet of the drain pipe; wherein the first outlet channel and the second outlet channel are respectively located on each of the two sides of the bowl portion divided by a longitudinal central axis of the bowl portion; the first outlet is located at a middle portion between a position P1 and a position P2 of the bowl portion while the position P1 is located at a junction point where the bowl portion is changed from a smaller radius of curvature to a larger radius of curvature and the position P2 is at the back of the bowl portion; the second outlet is located at a middle portion between a position P3 and the position P2 of the bowl portion while the position P3 is the junction point where the bowl portion is changed from a larger radius of curvature to a smaller radius of curvature; the second outlet channel further includes a curved potion for guiding and changing the direction of water flow; thus the direction of the second water flow which moves along the shed portion after flowing from the second outlet to the shed portion is consistent with the direction of the first water flow which moves along the shed portion after flowing from the first outlet to the shed portion so as to generate a swirling flow.

2. The flush toilet as claimed in claim 1, wherein an arc length traveled along the shed portion from the first outlet to the position P1 is defined as Si while another arc length traveled along the shed portion from the position P2 to the first outlet is defined as S2; the ratio of S1 to S2 (S1/52) ranges from 0.4 to 0.6.

3. The flush toilet as claimed in claim 1, wherein an arc length traveled along the shed portion from the second outlet to the position P2 is defined as S3 while another arc length traveled along the shed portion from the position P3 to the second outlet is defined as S4; the ratio of S3 to S4 (S3/S4) is ranging from 0.2 to 0.4.

4. The flush toilet as claimed in claim 1, wherein cross-sectional area of the first outlet is larger than cross sectional area of the second outlet.

5. The flush toilet as claimed in claim 1, wherein the ratio of the water flowing out of the first outlet, the second outlet and the jet hole is 0.6:0.4:3.8 when the amount of water the inlet channel can supply is 4.8 liter (L).

6. The flush toilet as claimed in claim 1, wherein a lower part the shed portion is inclined downward from the horizontal toward the bottom of the bowl portion and a height difference of the lower part of the shed portion is ranging from 0 mm to 2.5 mm.

7. The flush toilet as claimed in claim 1, wherein a width of the shed portion is gradually decreased from the first outlet to the position P1 along the direction of the water flow, becoming fixed from the position P1 to the position P3 along the direction of the water flow, getting narrower from the position P3 to the second outlet along the direction of the water flow and gradually reduced from the second outlet to the first outlet along the direction of the water flow; the width of the shed portion at the position of the first outlet is about the same as the width of the shed portion at the position of the second outlet.

8. The flush toilet as claimed in claim 1, wherein the width of the inlet channel is getting narrower from the water inlet to the diversion area along the direction of water flow.

9. The flush toilet as claimed in claim 1, wherein the width of the first outlet channel is getting smaller along the direction of water flow.

10. The flush toilet as claimed in claim 1, wherein the width of the second outlet channel is gradually decreased along the direction of water flow.

11. The flush toilet as claimed in claim 1, wherein the width of the jet channel is gradually reduced along the direction of water flow.

12. The flush toilet as claimed in claim 1, wherein a time difference between the time of the first water flow flowing out of the first outlet and the time of the second water flow flowing out of the second outlet is within 1.5 seconds.

13. The flush toilet as claimed in claim 1, wherein a part of a side wall of the first outlet channel, a part of a side wall of the second outlet channel and a side wall of the shed portion next to the first and the second outlet channels are formed by a partition assembly which is located and adhered between a bottom wall surface of the first outlet channel/the second outlet channel and a bottom wall surface of a seat.

14. The flush toilet as claimed in claim 13, wherein the partition assembly is composed of a first partition plate and a second partition plate; the first partition plate is a curved strip which forms a part of the side wall of the first outlet channel, a part of the side wall of the second outlet channel, and the first outlet; the second partition plate which is able to be L-shaped, U-shaped or C-shaped forms a part of the side wall of the second outlet channel close to the second outlet; the second partition plate is in combination with the first partition plate to form a part of the second outlet.

* * * * *